US008884823B2

(12) United States Patent
Kim

(10) Patent No.: US 8,884,823 B2
(45) Date of Patent: Nov. 11, 2014

(54) ANTENNA WITH VIA FENCE

(75) Inventor: Dong Young Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 230 days.

(21) Appl. No.: 13/467,543

(22) Filed: May 9, 2012

(65) Prior Publication Data

US 2012/0287008 A1 Nov. 15, 2012

(30) Foreign Application Priority Data

May 11, 2011 (KR) ..... 10-2011-0043854

(51) Int. Cl.

| | |
|---|---|
| ***H01Q 1/38*** | (2006.01) |
| ***H01Q 9/04*** | (2006.01) |
| ***H01Q 1/48*** | (2006.01) |
| ***H01Q 1/52*** | (2006.01) |

(52) U.S. Cl.

CPC ..... *H01Q 9/0457* (2013.01); *H01Q 9/0485* (2013.01); *H01Q 1/48* (2013.01); *H01Q 1/52* (2013.01)

USPC ..... 343/700 MS

(58) Field of Classification Search

CPC ..... H01Q 1/38; H01Q 9/0407; H01Q 9/0457; H01Q 21/065; H01Q 9/0485

USPC ..... 343/700 MS; 333/219.1

See application file for complete search history.

(56) References Cited

U.S. PATENT DOCUMENTS

| | | | | |
|---|---|---|---|---|
| 6,642,908 | B2 * | 11/2003 | Pleva et al. | 343/876 |
| 8,723,732 | B2 * | 5/2014 | Lee et al. | 343/700 MS |
| 2006/0256016 | A1 | 11/2006 | Wu et al. | |
| 2011/0248891 | A1 * | 10/2011 | Han et al. | 343/700 MS |
| 2012/0119969 | A1 * | 5/2012 | MacDonald et al. | 343/841 |

FOREIGN PATENT DOCUMENTS

| | | | |
|---|---|---|---|
| KR | 10-2005-0060947 | A | 6/2005 |
| KR | 10-2009-0023364 | A | 3/2009 |
| KR | 10-2011-0026654 | A | 3/2011 |

OTHER PUBLICATIONS

Tomohiro Seki et al., "Microstrip Array Antenna with Parasitic Elements Alternately Arranged Over Two Layers of LTCC Substrate for Millimeter Wave Applications", IEEE, Jan. 2007, pp. 149-152.

Antti E. I. Lamminen et al., "60-GHz Patch Antennas and Arrays on LTCC With Embedded-Cavity Substrates", IEEE Transactions on Antennas and Propagation, Sep. 2008, pp. 2865-2874, vol. 56, No. 9.

* cited by examiner

*Primary Examiner* — Robert Karacsony

(74) *Attorney, Agent, or Firm* — Rabin & Berdo, P.C.

(57) ABSTRACT

An antenna includes: a dielectric resonator surrounded by a via fence within a multilayered substrate; a patch antenna formed on an opening surface of the dielectric resonator; a coupling aperture formed on an internal ground surface within the multilayered substrate; and a feeding line for transferring a signal applied from the outside.

11 Claims, 10 Drawing Sheets

<PRIOR ART>

<PRIOR ART>

<PRIOR ART>

ANTENNA WITH VIA FENCE

CROSS-REFERENCE TO RELATED APPLICATIONS

This application is based on and claims priority from Korean Patent Application No. 10-2011-0043854, filed on May 11, 2011, with the Korean Intellectual Property Office, the present disclosure of which is incorporated herein in its entirety by reference.

TECHNICAL FIELD

The present disclosure relates to a high-gain antenna whose radiation efficiency is high in a millimeter-wave frequency band, and more particularly, to an antenna which restrains propagation of surface waves leaked along a dielectric substrate, showing high gain and high efficiency characteristics.

BACKGROUND

Since frequencies of millimeter-wave bands exhibit excellent straightness and wide band characteristics as compared with frequencies of micrometer-wave bands, they are in the spotlight in the fields of radars and communication services. In particular, since millimeter-wave frequency bands have small wavelengths, antennas can be easily miniaturized and accordingly, a size of a system can be significantly reduced. Wide band communication using a frequency band of 60 GHz and vehicular radars using a frequency band of 77 GHz have already been commercialized and released as services using such millimeter-wave frequency bands.

As a method of constituting such a millimeter-wave frequency band system, studies on realization of the system in a form of system in packaging (SiP) are being actively conducted to miniaturize a product and reduce costs. A low temperature cofired ceramic (LTCC) or liquid crystal polymer (LCP) technology is considered as one of the most suitable technologies for SiP, and the LTCC or LCP technology basically employs a multilayered substrate and can miniaturize a module and realize low price by embedding passive parts such as a capacitor, an inductor, and a filter in the substrate. Further, since cavities can be formed freely in the multilayered substrate, the degree of freedom in design of the module increases.

Meanwhile, realization of antennas in the SiP system using LTCC is considered as an essential factor in the performance of the system. In general, when a patch antenna operated at a millimeter-wave frequency band, in particular, an ultra-high frequency band of not less than 60 GHz is manufactured, leakage of signals occurs in a form of surface waves flowing along a surface of a dielectric substrate. Such leakage of signals becomes severe as a thickness of the substrate increases, which causes permittivity of the substrates to increase. The leakage of signals reduces a radiation efficiency of the antenna, thus decreasing a gain of the antenna.

The currently released millimeter-wave frequency band modules are manufactured in the form of SiP by using the LTCC technology to reduce size and costs. However, as mentioned above, since permittivity of a ceramic substrate such as LTCC is high as compared with an organic substrate, a radiation efficiency and gain of the antennas decreases when the antenna is formed with a patch antenna. Accordingly, the number of arrays required increases rapidly to achieve a desired antenna gain. Thus, an existing product is manufactured with an organic substrate having low permittivity only for an antenna, and is coupled to an LTCC module in a hybrid form. Due to this, module size and manufacturing costs increase as compared with a case of manufacturing an entire SiP module including an antenna on a single LTCC substrate.

SUMMARY

The present disclosure has been made in an effort to provide an antenna which is operated in a millimeter-wave frequency band, in particular, in an ultra-high frequency band of not less than 60 GHz by using an LTCC technology employing a multilayered structure.

The present disclosure also has been made in an effort to provide an antenna which suppresses propagation of a surface wave on a ceramic substrate having a multilayered structure.

The present disclosure also has been made in an effort to provide an antenna which can be realized on one substrate together with a front-end module part.

An exemplary embodiment of the present disclosure provides an antenna, including: a dielectric resonator surrounded by a via fence within a multilayered substrate; a patch antenna formed on an opening surface of the dielectric resonator; a coupling aperture formed on an internal ground surface within the multilayered substrate; and a feeding line for transferring a signal applied from the outside.

As described above, the present disclosure provides an antenna having a patch antenna on a dielectric resonator, wherein the patch antenna serves as a reflective plate to increase a gain of the antenna so that the antenna shows high efficiency and high gain characteristics.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, an exemplary embodiment of the present disclosure will be described in detail with reference to the accompanying drawings. In the description of the present disclosure, a detailed description of known configurations and functions may be omitted to avoid obscure understanding of the present disclosure.

Figure 1:
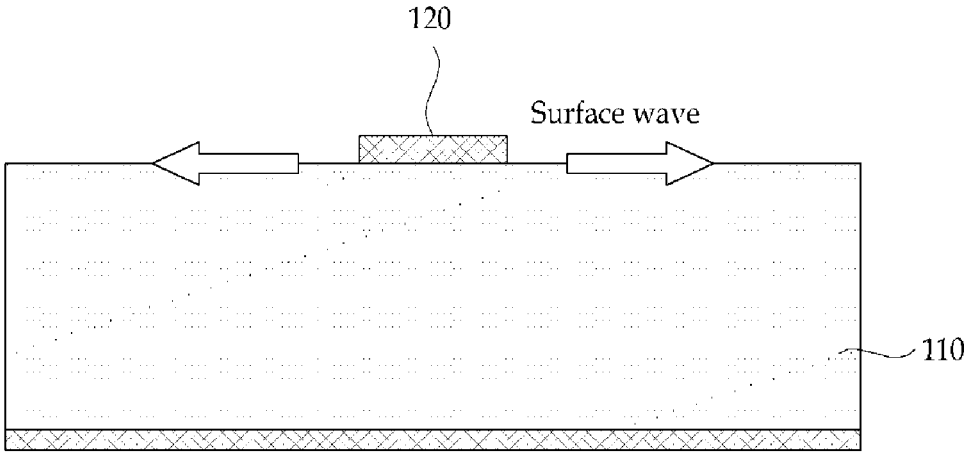
FIG. 1 is a view illustrating an antenna structure according to the related art.

FIG. 1 is a view illustrating an antenna structure according to the related art.

Referring to FIG. 1, in the antenna according to the related art, a patch antenna 120 is formed on a multilayered substrate 110. Here, permittivity of the multilayered substrate 110 is 7.2 and a thickness of each layer is 0.1 mm.

Figure 2A:
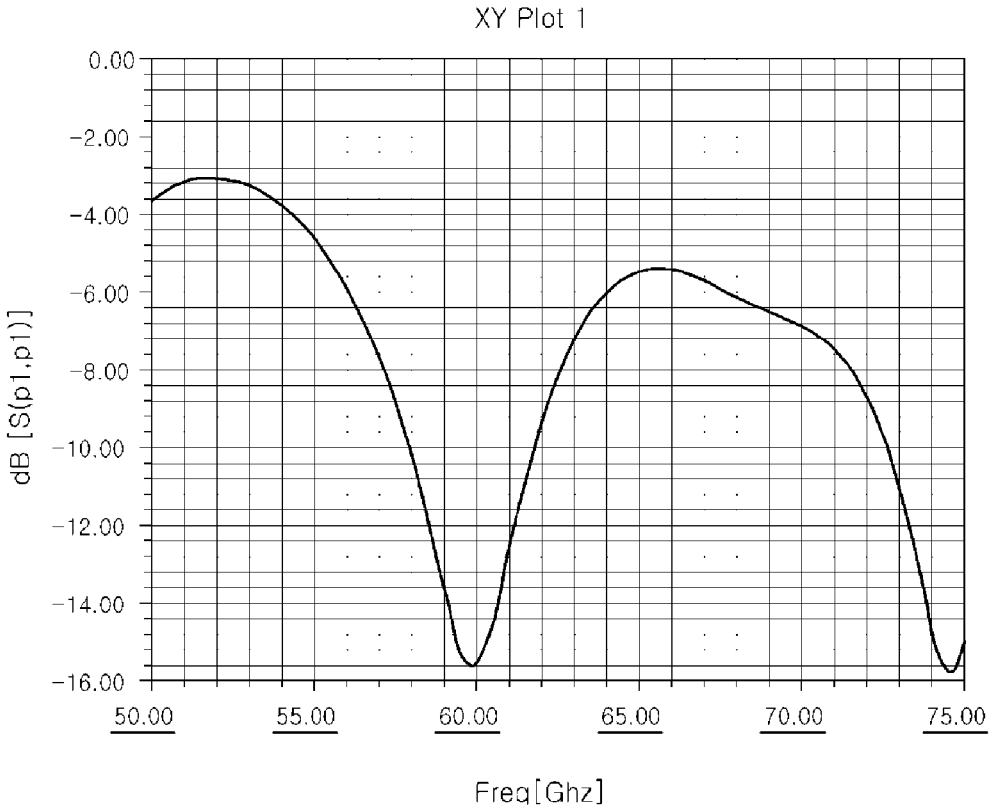
FIG. 2A is a graph illustrating a high frequency simulation software (HFSS) simulated experiment result of reflection characteristics S11 of the antenna of FIG. 1.

FIG. 2A is a graph illustrating a high frequency simulation software (HFSS) simulated experiment result of reflection characteristics S11 of the antenna of FIG. 1.

As illustrated in FIG. 2A, a frequency band of the antenna of FIG. 1 is 58 to 61.8 GHz, and a bandwidth of the frequency band is 3.8 GHz.

Figure 2B:
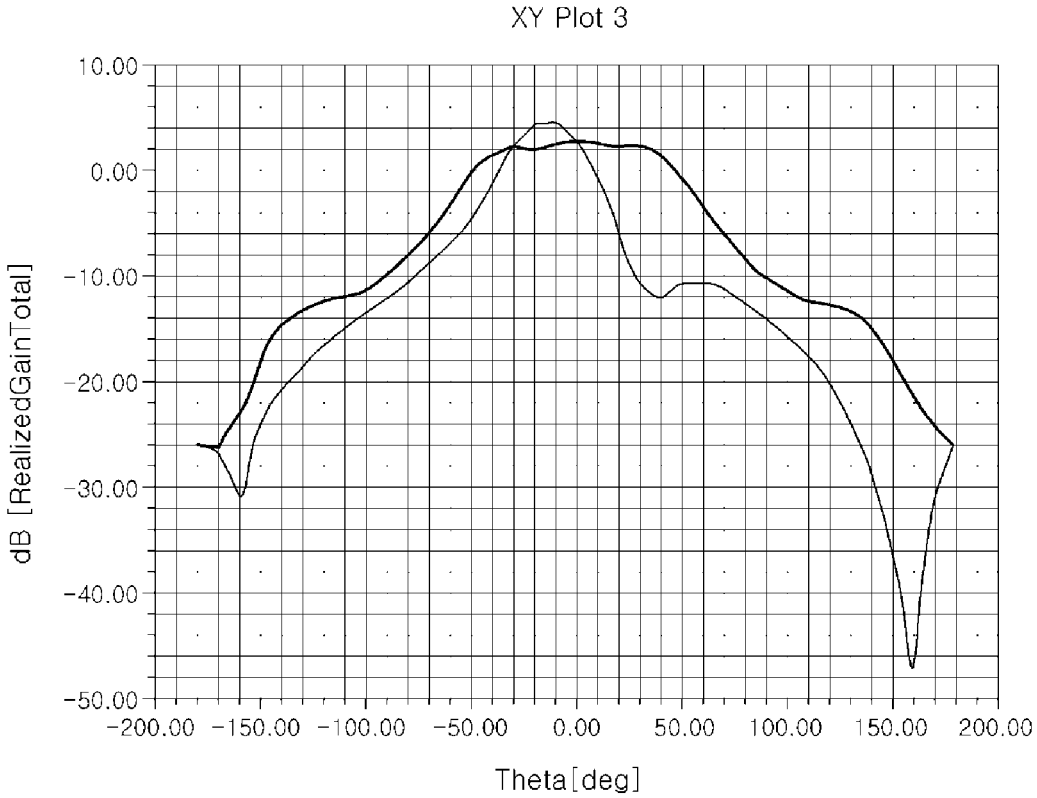
FIG. 2B is a graph illustrating an HFSS simulated experiment result of reflection characteristics (antenna gains) of the antenna of FIG. 1.

FIG. 2B is a graph illustrating an HFSS simulated experiment result of reflection characteristics (antenna gains) of the antenna of FIG. 1.

As illustrated in FIG. 2B, the antenna of FIG. 1 exhibits a maximum gain value of 4.2 dBi. A general single patch antenna exhibits the highest gain value in a direction perpendicular to a substrate. However, the antenna of FIG. 1 exhibits the highest gain value when theta is −15 degrees. Further, since the patch antenna 120 has a rhombus shape, the antenna of FIG. 1 will show very similar radiation characteristics along both directions which are perpendicular and parallel to a feeding line. However, as illustrated in FIG. 2B, gain values follow a left-and-right symmetrical form in a direction perpendicular to the feeding line, but a maximum point of gain values in the feeding line direction is displaced by approximately 15 degrees. This is because signals are leaked by surface waves, causing the signals to be radiated while the signals are flowing along the substrate. Thus, radiation efficiency of the antenna is 32.8% according to a simulated experiment result.

Figure 3:
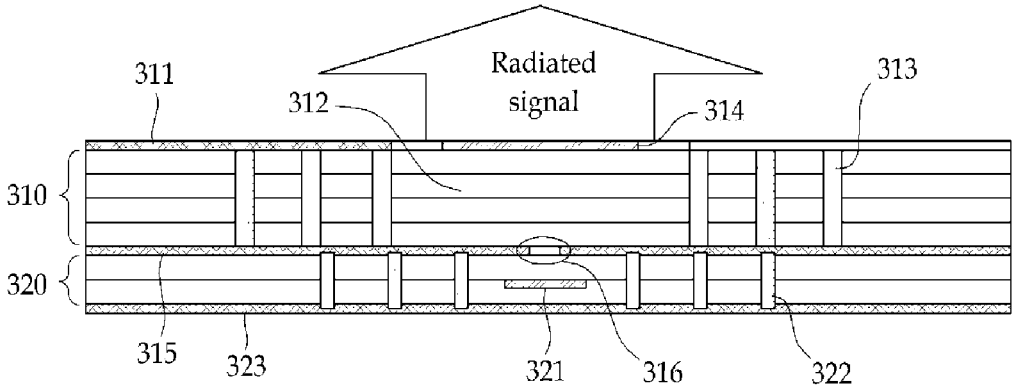
FIG. 3 is a view illustrating a structure of an antenna according to the present disclosure.

FIG. 3 is a view illustrating a structure of an antenna according to the present disclosure.

Referring to FIG. 3, the antenna according to the present disclosure includes a multilayered substrate formed of a low temperature cofired ceramic (LTCC) material and having permittivity of 6.0 and tan δ of 0.0035, and generally includes an antenna layer 310 including a dielectric resonator 312 and a feeding network layer 320 where a feeding line 321 for signal feeding is located. In more detail, the multilayered substrate includes six layers, and the four upper layers constitute the antenna layer 310 and the two lower layers constitute the feeding network layer 320.

Meanwhile, the antenna according to the present disclosure includes a surface metal layer 311, a dielectric resonator 312, a plurality of first vias 313, a patch antenna 314, an internal ground surface 315, a coupling aperture 316, a feeding line 321, a plurality of second vias 322, and a lower ground surface 323.

The surface metal layer 311 is formed in an upper region of the multilayered substrate except for a region where the dielectric resonator 312 is formed, by using a silver electrode.

The dielectric resonator 312 includes four layers and has a thickness of 0.4 mm. The dielectric resonator 312 is surrounded by the plurality of first vias 313, and the plurality of first vias 313 serves as a metal wall, preventing leakage of signals.

The patch antenna 314 is formed on an opening surface of the dielectric resonator 312 and constitutes a dual resonator together with the dielectric resonator 312. Here, the dielectric resonator 312 and the patch antenna 314 may be designed to resonate at a frequency of 77 GHz.

The internal ground surface 315 is formed on a bottom surface of the dielectric resonator 312 by using a silver electrode, and the coupling aperture 316 is located within the internal ground surface 315. The surface metal layer 311 and the internal ground surface 315 are electrically connected to each other through the plurality of first vias 313.

The two layers under the dielectric resonator 312, that is, the feeding network layer 320 is a layer where the feeding line 321 is located in a strip line form for feeding signals, the plurality of second vias 322 are located around the feeding line 321 to interrupt leakage of signals. Here, the plurality of second vias 322 electrically connects the internal ground surface 315 and the lower ground surface 323 to each other, and serve to interrupt signals leaked to the periphery of the feeding line 321.

Figure 4:
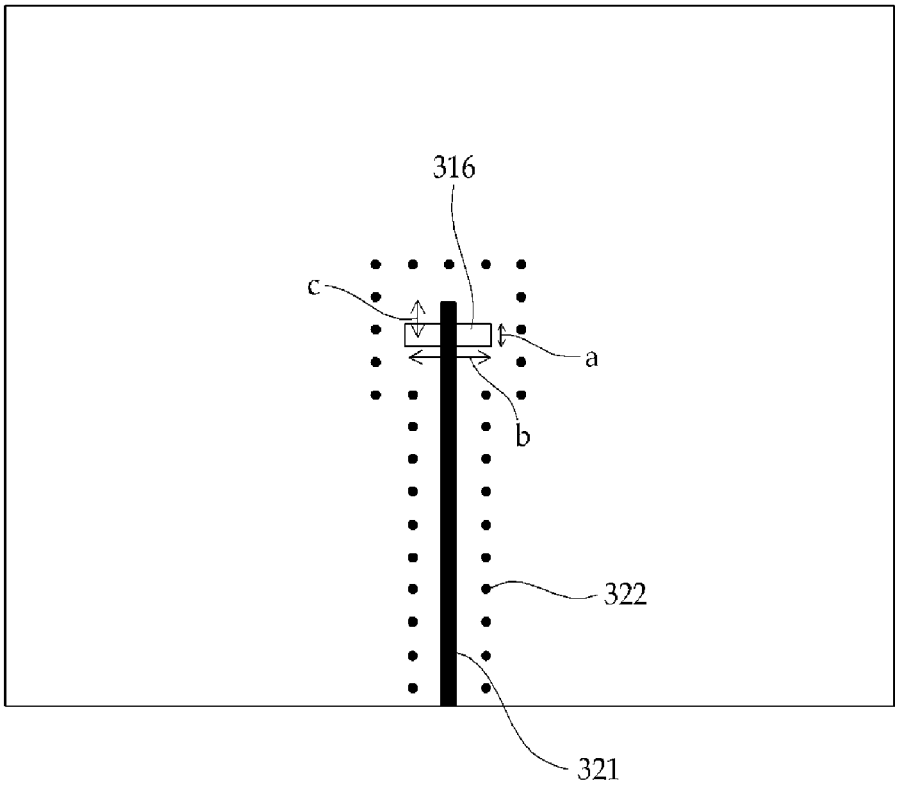
FIG. 4 is a plan view illustrating a strip-line-type feeding line and a coupling aperture of the antenna according to the present disclosure.

FIG. 4 is a plan view illustrating the strip line feeding line and the coupling aperture of the antenna according to the present disclosure.

As illustrated in FIG. 4, the feeding line 321 for feeding signals is located in the two layers under the multilayered substrate, that is, the feeding network layer 320, and the coupling aperture 316 for feeding signals to the antenna is present on the internal ground surface 315 between the antenna layer 310 and the feeding line 321. Here, the feeding line 321 is surrounded by the plurality of second vias 322 for preventing leakage of signals. Then, a width a and length b of the coupling aperture 316, and a length c of the feeding line 321 are designed for smooth coupling to the dielectric resonator 312 at an operation frequency band of the antenna.

Since the uppermost surface of the antenna is covered with a metal except for the aperture of the dielectric resonator 312 in the antenna structure, leakage of signals due to generation of surface waves can be prevented, and signals applied from the feeding line 321 are radiated to the outside through the dielectric resonator 312 and the patch antenna 314 without loss of signals due to surface waves. Then, the patch antenna 314 located on a surface increases a gain of the antenna, exhibiting high gain characteristics as compared with the antenna including an existing dielectric resonator.

Figure 5A:
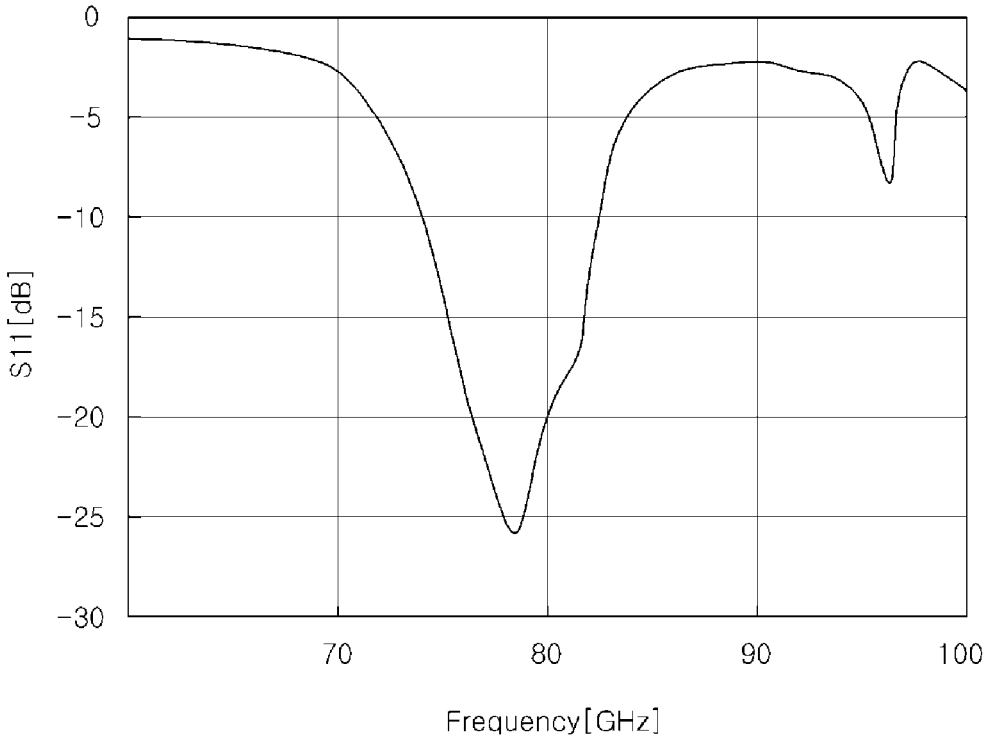
FIG. 5A is a graph illustrating an HFSS simulated experiment result of reflection characteristics S11 of the antenna according to the present disclosure.

FIG. 5A is a graph illustrating an HFSS simulated experiment result of reflection characteristics S11 of the antenna according to the present disclosure.

As illustrated in FIG. 5A, it can be seen that a frequency band of the antenna has a reflection loss of which is not more than 10 dB is 74.1 to 82.6 GHz and the frequency band has a wide bandwidth of 8.5 GHz in the present disclosure. That is, it can be seen that the antenna according to the present disclosure exhibits considerably wide frequency band characteristics as compared with the antenna of FIG. 1.

Figure 5B:
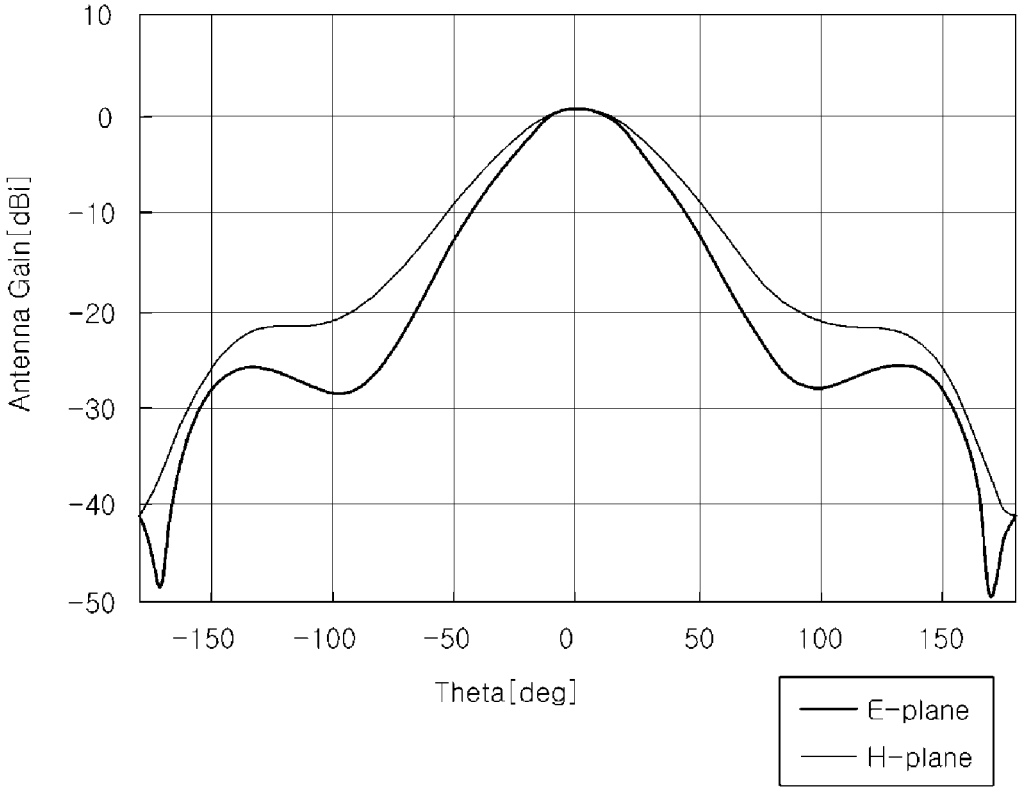
FIG. 5B is a graph illustrating an HFSS simulated experiment result of reflection characteristics (antenna gains) of the antenna according to the present disclosure.

FIG. 5B is a graph illustrating an HFSS simulated experiment result of reflection characteristics (antenna gains) of the antenna according to the present disclosure.

Figure 5C:
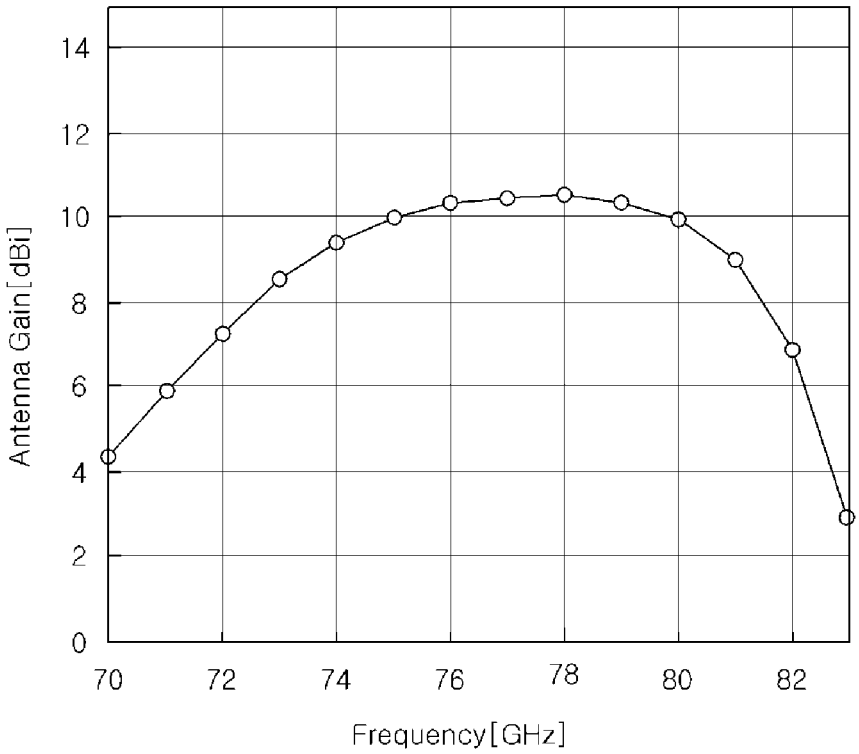
FIG. 5C is a graph illustrating an HFSS simulated experiment result of a change in gain depending on the frequency of the antenna according to the present disclosure.

As illustrated in FIG. 5B, it can be seen that the antenna according to the present disclosure has a gain of 10.5 dBi at a frequency of 77 GHz, exhibiting high gain characteristics as compared with the antenna structure of FIG. 1. Moreover, as illustrated in FIG. 5C, it can be seen that the antenna has a gain of not less than 10 dBi at a frequency band of 75 to 80 GHz, exhibiting flat characteristics.

Figure 6:
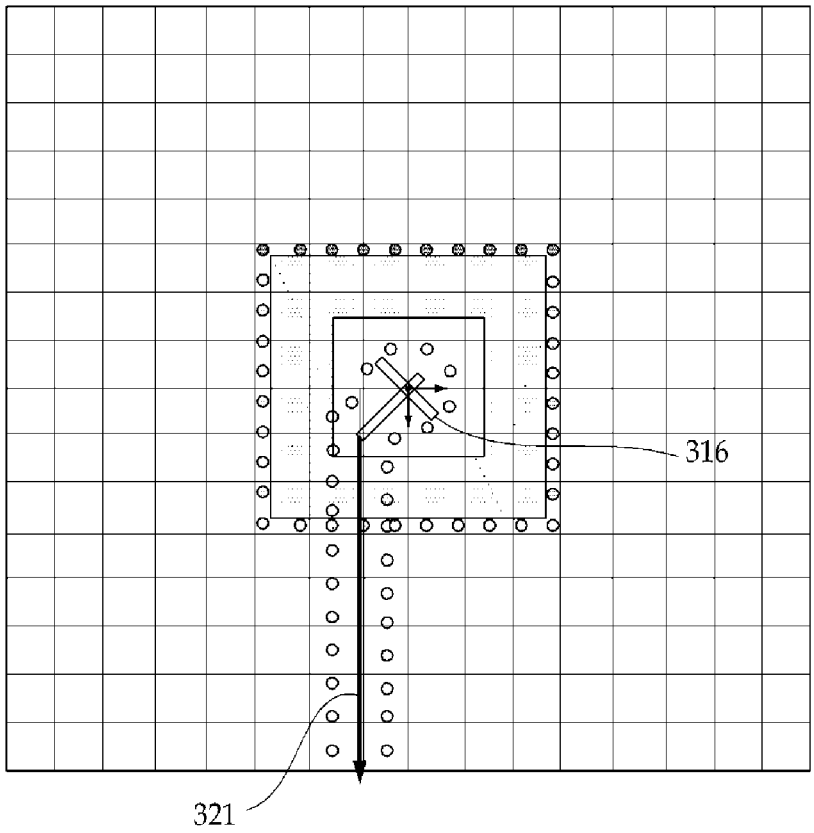
FIG. 6 is a view illustrating an antenna structure where only a coupling aperture and a feeding line are inclined by 45° in the antenna structure of FIG. 3.

FIG. 6 is a view illustrating an antenna structure where only a coupling aperture and a feeding line are inclined by 45° in the antenna structure of FIG. 3.

In general, when it comes to an antenna whose power is supplied through a coupling aperture, it is difficult to arrange an electric field of a signal radiated from the antenna in the major axis direction of the coupling aperture because the signal has linear polarization where the electric field is arranged in the minor axis direction thereof. Thus, if the coupling aperture 316 of the antenna according to the present disclosure is inclined by 45° as illustrated in FIG. 6, the polarization of the antenna is also inclined at 45°. The 45° polarization is one of major characteristics especially in the automobile industry, and since signals radiated from vehicles approaching each other have a polarization difference of 90°, the polarization prevents interference of signals radiated from a different vehicle.

Figure 7A:
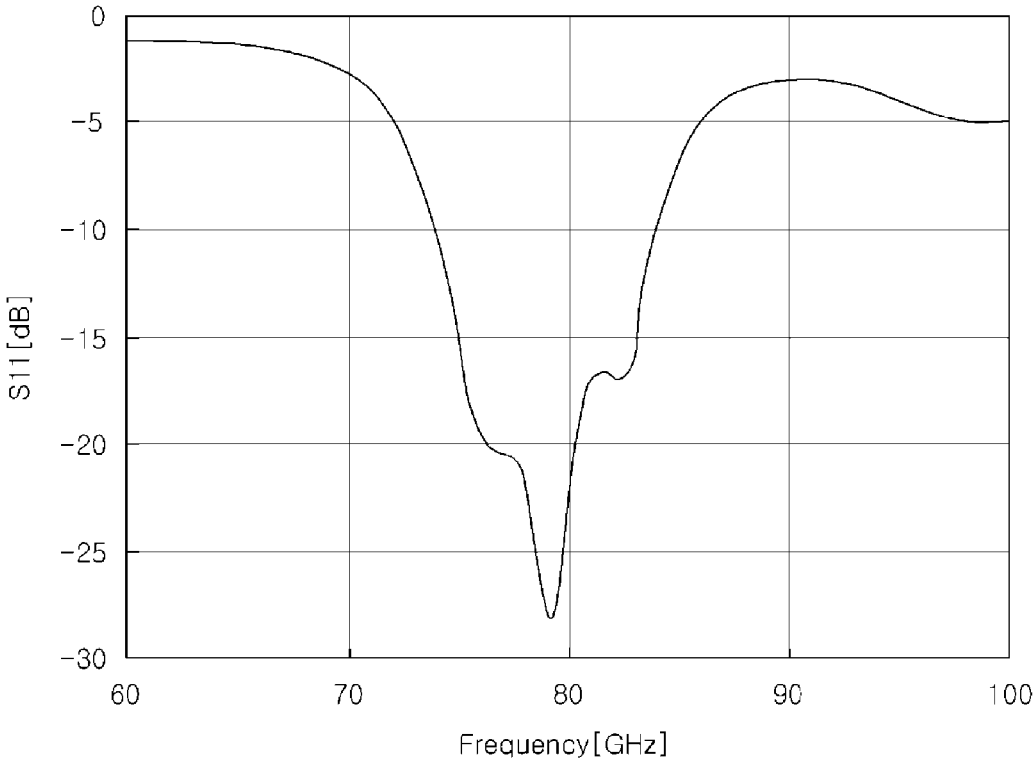
FIG. 7A is a graph illustrating an HFSS simulated experiment result of reflection characteristics S11 of the antenna of FIG. 6.

Thus, as illustrated in FIG. 7A, it can be seen that a frequency band of an antenna having a 45° linear polarization shows a reflection loss of not more than 10 dB is 73.9 to 83.9 GHz and has a wide bandwidth of 10 GHz. The bandwidth of 10 GHz is a value slightly higher than 8.5 GHz which is the bandwidth of the antenna of FIG. 1.

Figure 7B:
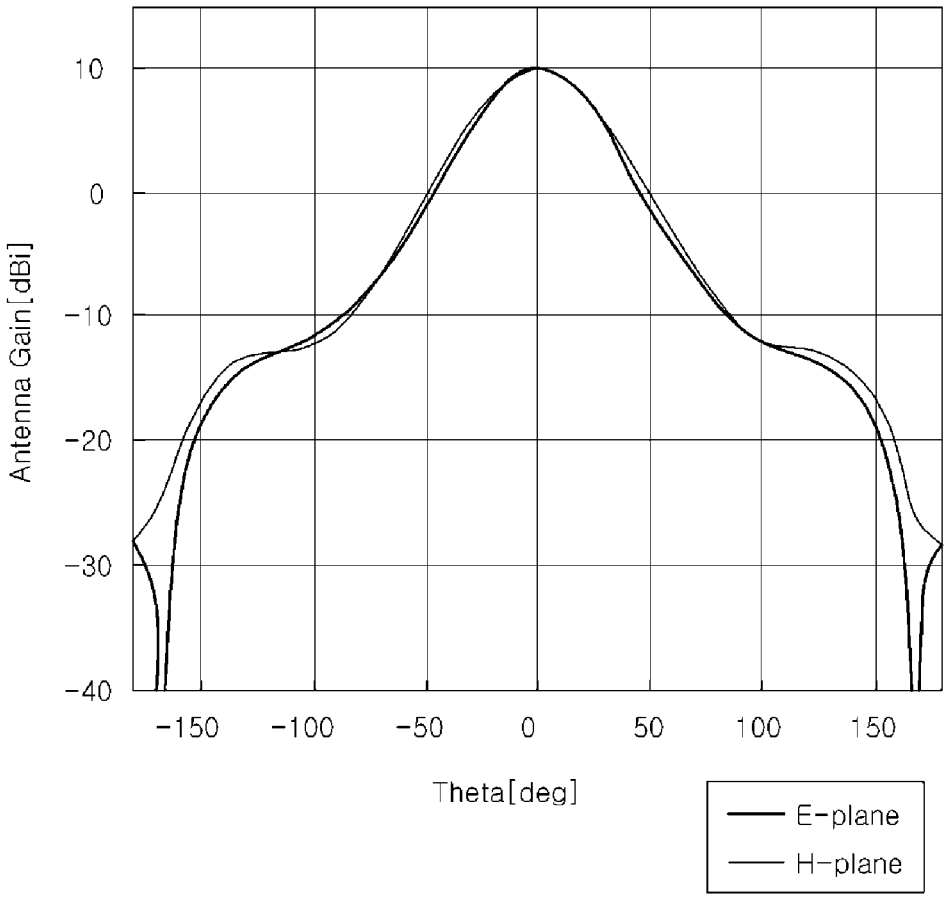
FIG. 7B is a graph illustrating an HFSS simulated experiment result of reflection characteristics (antenna gains) of the antenna of FIG. 6 at a frequency of 77 GHz.

As illustrated in FIG. 7B, it can be seen that a gain of the antenna according to the present disclosure at a frequency of 77 GHz is 10.3 dBi which is a value slightly lower than 10.5 dBi which is the gain of the antenna of FIG. 1.

As described above, the antenna according to the present disclosure can easily regulate a polarization direction of the antenna by simply rotating the coupling aperture 316 and the feeding line 321.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. An antenna, comprising:

a dielectric resonator surrounded by a first via fence for interrupting leakage of signals within a multilayered substrate;

a patch antenna formed on an opening surface of the dielectric resonator;

a coupling aperture formed on an internal ground surface within the multilayered substrate; and a feeding line for transferring a signal applied from the outside;

wherein the feeding line is surrounded by a second via fence for interrupting leakage of signals.

2. The antenna of claim 1, wherein the dielectric resonator is formed within the multilayered substrate by using the via fence, and the via fence suppresses leakage of a signal through the multilayered substrate.

3. The antenna of claim 1, wherein the via fence includes a plurality of via walls surrounding the dielectric resonator.

4. The antenna of claim 1, wherein a size and thickness of the dielectric resonator is determined to resonate at an in-use frequency band.

5. The antenna of claim 1, wherein a bandwidth of the antenna is expanded by a coupling through the coupling aperture between the dielectric resonator and the feeding line.

6. The antenna of claim 1, wherein the antenna enhances a gain by using the additional patch.

7. The antenna of claim 1, wherein the feeding line has a form of a strip line.

8. The antenna of claim 1, wherein the antenna regulates directions of the coupling aperture and the feeding line to regulate antenna polarization.

9. The antenna of claim 1, wherein the multilayered substrate comprises a plurality of upper antenna layers disposed on a plurality of lower feeding network layers.

10. The antenna of claim 9, wherein the internal ground surface is disposed between the plurality of upper antenna layers and the plurality of lower feeding network layers.

11. The antenna of claim 10, wherein the feeding line is disposed on a layer of the plurality of lower feeding network layers and substantially aligned with the coupling aperture.

* * * * *